US009809280B2

(12) United States Patent
Miller et al.

(10) Patent No.: US 9,809,280 B2
(45) Date of Patent: Nov. 7, 2017

(54) CLEAT HAVING AN ADJUSTABLE ANCHORING STRUCTURE

(71) Applicants: Steven Miller, Pinellas Park, FL (US); Timo Pascal Kommerling, Riedelberg (DE)

(72) Inventors: Steven Miller, Pinellas Park, FL (US); Timo Pascal Kommerling, Riedelberg (DE)

( * ) Notice: Subject to any disclaimer, the term of this patent is extended or adjusted under 35 U.S.C. 154(b) by 118 days.

(21) Appl. No.: 14/946,446

(22) Filed: Nov. 19, 2015

(65) Prior Publication Data

US 2017/0144730 A1 May 25, 2017

(51) Int. Cl.
*B63B 21/20* (2006.01)
*B63B 9/00* (2006.01)
*B63B 59/02* (2006.01)

(52) U.S. Cl.
CPC ..... *B63B 21/20* (2013.01); *B63B 9/00* (2013.01); *B63B 59/02* (2013.01)

(58) Field of Classification Search
CPC ..... B63B 21/045
See application file for complete search history.

(56) References Cited

U.S. PATENT DOCUMENTS 533,760 A * 2/1895 Vachon ..... B63B 21/045 114/218
3,126,859 A * 3/1964 Bigelow ..... B63B 21/045 114/218
2012/0017817 A1* 1/2012 Martzall ..... B63B 21/045 114/218

* cited by examiner

*Primary Examiner* — Edwin Swinehart
(74) *Attorney, Agent, or Firm* — Tiffany C. Miller; Inventions International Inc.

(57) ABSTRACT

A cleat having an adjustable anchoring system configured to suspend a bumper. The cleat has a first horn located opposite a second horn. A support structure is connected to the cleat. A recess of the support structure has a ridge protruding from a wall surface of the recess. The ridge is configured to deform a portion of rope. A bore of the support structure is configured to receive a fastener. A base has a bore configured to receive the fastener. The bore of the support structure is oriented to align with the bore of the base. The base has two ramps that protrude from a wall surface of a recess of the base. The two ramps form a pocket that can have a protrusion configured to bind a portion of the rope when the fastener is tightened.

24 Claims, 23 Drawing Sheets

CLEAT HAVING AN ADJUSTABLE ANCHORING STRUCTURE

BACKGROUND OF THE INVENTION

1. Field of the Invention

This invention relates, generally, to a nautical cleat for use with boats or docks. More particularly, this invention relates to a bumper system suspended by a cleat having an adjustable anchoring structure.

2. Background Art

Prior art cleats have been embodied in various configurations. The most common type of cleat is the traditional cleat described in U.S. Pat. No. 1,034,222. This traditional cleat has two horizontal elements integrated in its structure, allowing a user to attach a rope usually in a crisscross tying arrangement. U.S. Pat. No. 3,126,858 describes a cleat in which a mooring line is passing through two openings and a recess before being tied into a knot. Cam cleats as seen in U.S. Pat. No. 6,857,381 teaches a more complicated gear mechanism configured to pass a rope through. Jam cleats as seen in U.S. Pat. No. 3,715,782 utilize a v-shaped slot to pinch a line in place.

These prior art cleats are designed in a way that limits the space available to secure multiple ropes. The first problem arises when a single rope is tied to a cleat. This knot obstructs the cleat from receiving a second line. For instance, it is a common practice to hang a boat fender from a dock cleat by a rope. However, this first attachment obstructs the cleat from receiving the mooring line of a vessel. Although U.S. Pat. No. 3,948,203 describes a cleat with multiple attachment cites, a novel capturing structure is not present, requiring a lengthy process of tying a knot to secure the rope to the cleat.

While these prior art devices fulfill their respective, particular objectives and requirements, there is still a need for a cleat with a novel capturing structure to retain a rope or a length of flexible restraining material in a non-obstructing manner so that full use of the cleat structure will not be hindered or sacrificed. Commercially available cleats are not equipped to bind a portion of the rope between a cleat and an anchoring surface and requires a user to use multiple cleats when attaching multiple lines, which is problematic. It is more practical to stabilize both a bumper and a vessel on a single cleat.

SUMMARY OF THE INVENTION

The long-standing but heretofore unfulfilled need for a cleat having an adjustable anchoring structure. The novel cleat has a first horn located opposite a second horn. A support structure is connected to the cleat. A recess of the support structure has a protrusion protruding from a wall surface of the recess. The protrusion is configured to deform a portion of rope. A bore of the support structure is configured to receive a fastener. A base has a bore configured to receive the fastener. The bore of the support structure is oriented to align with the bore of the base. The base has two ramps that protrude from a wall surface of a recess of the base. The two ramps form a pocket that can have a protrusion configured to bind a portion of the rope when the fastener is tightened which also includes improvements that overcome the limitations of prior art cleats is now met by a new, useful, and non-obvious invention.

In a preferred embodiment, the novel cleat has a first horn located opposite a second horn. It is within the scope of this invention for the cleat to have at least one horn or a single horn (not shown). The novel cleat has at least one support structure having at least one recess. At least one protrusion protrudes from a wall surface of the at least one recess of the at least one support structure. At least one protrusion is configured to deform a portion of a length of material. It is within the scope of this invention for a protrusion to include, but not be limited to, a ridge, a spike or a tooth designed so that when the cleat is fastened to the anchoring surface, the length of material would be pinched between the anchoring surface and the protrusion of the cleat. This results in a clamping effect, thereby, binding a portion of the length of material and providing a strong attaching point for the length of material to be secured by the cleat in a non-obstructing manner so that full use of the cleat will not be hindered or sacrificed. A length of material includes, but is not limited to, a rope, a cable, a cord, or a chain.

At least one support structure has a bore configured to receive a fastener. It is within the scope of this invention for a fastener to include, but not be limited to, a screw, a bolt, a rivet, or any hardware that will draw the cleat to the anchoring surface. The pressure from the installed cleat secures a length of material through the recess.

In a preferred embodiment, the cleat is removably connected to a base having a bore configured to receive the fastener. The bore of the at least one support structure is oriented to align with the bore of the base. The base has at least one recess. The base has at least two ramps protruding from a wall surface of the at least one recess of the base. The at least two ramps are oriented to form a pocket.

The novel cleat is made of a material including, but not limited to, plastic, metal or composite, a fluorescent material, and can have a surface with a fluorescent material. A length of material is pinched between a ridge of at least one support structure of the cleat and an anchoring surface. An anchoring surface includes, but is not limited to, a dock, a vessel, a base, or any structure affixed or not affixed such as a vessel. This configuration allows for the novel cleat to secure a bumper to a mounting surface without obstructing the cleat horns for use with additional ropes.

In another preferred embodiment, the cleat has a primary horn located opposite a secondary horn. The cleat has at least one support structure connected to the cleat. The at least one support structure has at least one recess. At least ramps protrude from a wall surface of at least one recess of at least one support structure. The at least two ramps are oriented to form a pocket. The at least one support structure has a bore configured to receive a fastener. The cleat has a base having a bore configured to receive the fastener. The bore of the at least one support structure is oriented to align with the bore of the base. The at least one ridge protrudes from a wall surface of the at least one recess of the base. The at least one ridge is configured to deform a portion of a length of material.

In an alternate embodiment, the cleat can have a light emitting unit. The light emitting unit can be connected to the cleat. It is within the scope of the current invention for the cleat to have at least one compartment. The compartment can contain a light emitting unit.

In another embodiment, the cleat can have a power device. It is within the scope of this invention for a power device to include, but not be limited to, a battery, a power cord, or circuitry such as a capacitor. The power device can be rechargeable by at least one solar cell. It is within the scope of this invention for the at least one solar cell to be positioned in at least one opening of at least one compartment of the cleat.

In yet another embodiment, the base can have a tapered wall surface.

In yet another embodiment, the base has a radial guide having a projecting structure configured to retain a portion of the length of material on the radial guide. It is within the scope of this invention for the radial guide to have a projecting structure including, but not limited to, a groove, a partial groove, an overhanging tab, or an overhanging lip of a groove.

In another embodiment, the pocket further has at least one protrusion configured to bind a portion of the length of material when the fastener is tightened. A length of material being of a smaller diameter in size compared to the recess, could be retained within the recess when at least one protrusion binds the length of material in place.

In yet another embodiment, at least one support structure has an alignment structure configured to mate with a mirroring alignment structure formed on the base. It is within the scope of the current invention for a mirroring alignment structure to include, but not be limited to, a recess and a protrusion, a lock and key interlocking configuration, a male/female configuration, or any shape as long as the shapes mirror so that the base and the cleat align.

In yet another embodiment, at least one support structure has an alignment structure configured to mate with a mirroring alignment structure formed on the anchoring surface.

In an alternate embodiment, the cleat has a first horn located opposite a second horn. The cleat also has at least one support structure associated with a recess. The recess can be located on including, but not limited to, on the support structure of the cleat or on the anchoring surface. The recess is configured to grip a portion of a length of material when at least one support structure is fastened to an anchoring surface by a fastener. In a preferred embodiment, the recess includes, but is not limited to, a half-circle shape or any shape capable of retaining a length of material.

In another alternate embodiment, a method of a bumper being suspended by a cleat anchoring system has the steps of providing at least one bumper associated with at least one opening configured to support the at least one bumper. The opening associated with a bumper includes, but is not limited to, an eyelet, a central bore, a hole through the bumper, a hole traversing from one end of the bumper to another end of the bumper, or any opening capable of supporting the bumper.

Providing a length of material. Providing at least one cleat having a first horn located opposite a second horn. The cleat having at least one support structure. The at least one support structure associated with a recess. The recess is configured to grip a portion of the length of material when the at least one support structure is fastened to an anchoring surface by a fastener. A user placing a portion of the length of material between the at least one support structure associated with a recess and the anchoring surface. Fastening the at least one support structure to an anchoring surface by the fastener. A user placing the length of material through at least one opening associated with at least one bumper.

Providing at least one retaining member configured to limit the movement of the at least one bumper from traversing the length of material. Orienting at least one retaining member on the length of material. The at least one retaining member is positioned to limit at least one bumper from traversing the length of material in a primary direction. It is within the scope of this invention for a retaining member to include, but not be limited to, a clip, a pin, or a knot.

In an alternate embodiment, the method of a bumper being suspended by a cleat anchoring system has the steps of providing a second cleat. The second cleat has a first horn located opposite a second horn. The second cleat has at least one support structure associated with a recess. The recess is configured to grip a portion of the length of material when the at least one support structure is fastened to an anchoring surface by a fastener. The at least one bumper is suspended between the first cleat and the second cleat.

In an alternate embodiment, the method of a bumper being suspended by a cleat anchoring system has the steps of providing a radial guide. A user passes the length of material over the radial guide. Providing a second cleat having a second support structure associated with a second recess. The second recess is configured to grip a second portion of the length of material when the second support structure is fastened to an anchoring surface by a second fastener. The user places the second portion of the length of material between the second support structure associated with the second recess. The second cleat is loosely fitted with a fastener of the second cleat. The user pulls the length of material to a desired length. The user tightens at least one fastener of the second cleat to retain the second portion of the length of material.

In yet another embodiment, the method of a bumper being suspended by a cleat anchoring system has the steps of providing a second retaining member configured to limit the movement of the at least one bumper from traversing the length of material. Orienting the second retaining member on the length of material. The second retaining member is positioned to limit the movement of the at least one bumper from traversing the length of material in a second direction.

In yet another embodiment, the method of a bumper being suspended by a cleat anchoring system has the steps of providing at least one retaining member having a first portion connected to a second portion by a hinge. It is within the scope of this invention for the hinge to include, but not be limited to, material that bends such as plastic or metal. At least one portion of the at least one retaining member has a protrusion configured to bind to a portion of the length of material when at least one retaining member is in a closed orientation. It is within the scope of this current invention for the retaining member to be a clamp without a protrusion.

In yet another embodiment, the method of a bumper being suspended by a cleat anchoring system has the steps of providing at least one retaining member having a first portion latched to a second portion when oriented in a closed position. It is within the scope of this current invention for a the first portion of the retaining member to be held in place by a latch when in a closed orientation with the second portion of the retaining member with a fastener including, but not be limited to, a rivet, a screw, a clamp, or a strap.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
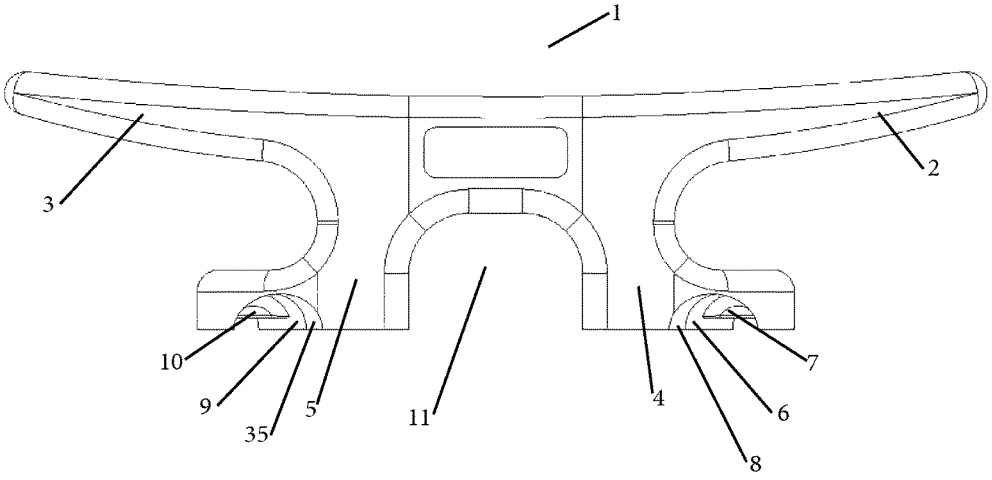
FIG. 1 is a side perspective view of the novel cleat.
Figure 2:
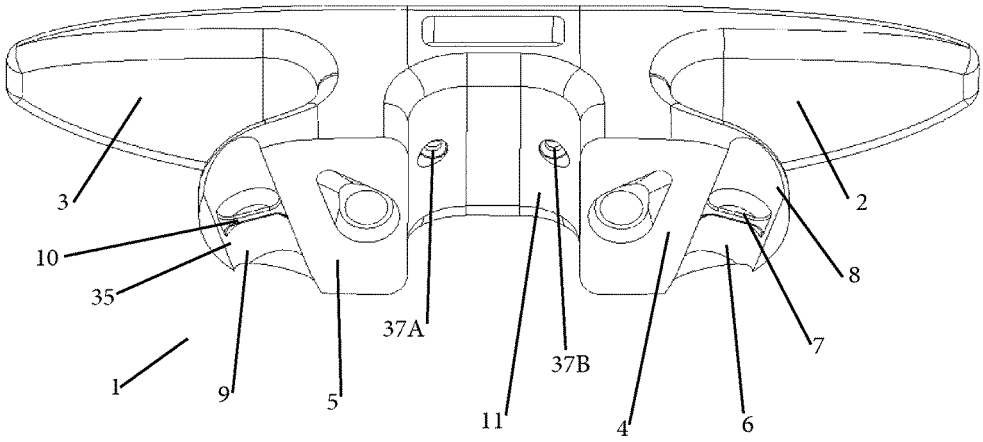
FIG. 2 is a bottom perspective view of the novel cleat.
Figure 3:
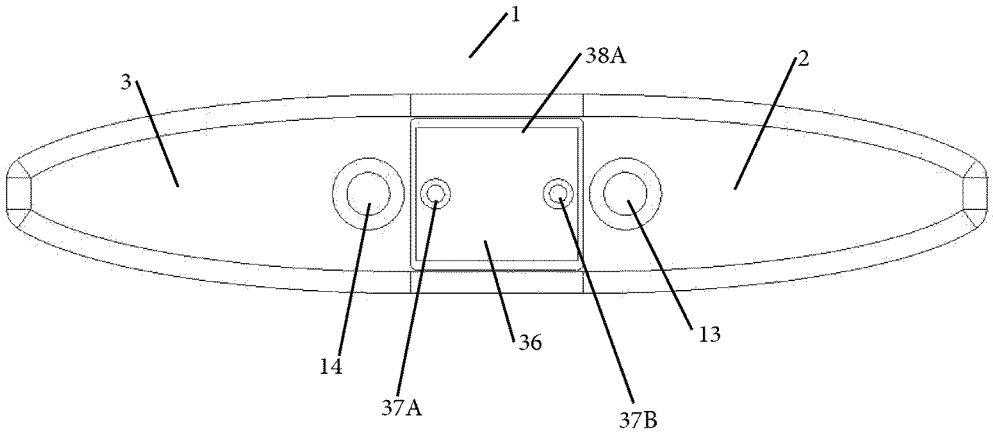
FIG. 3 is a top plan view of the novel cleat having a compartment.
Figure 4:
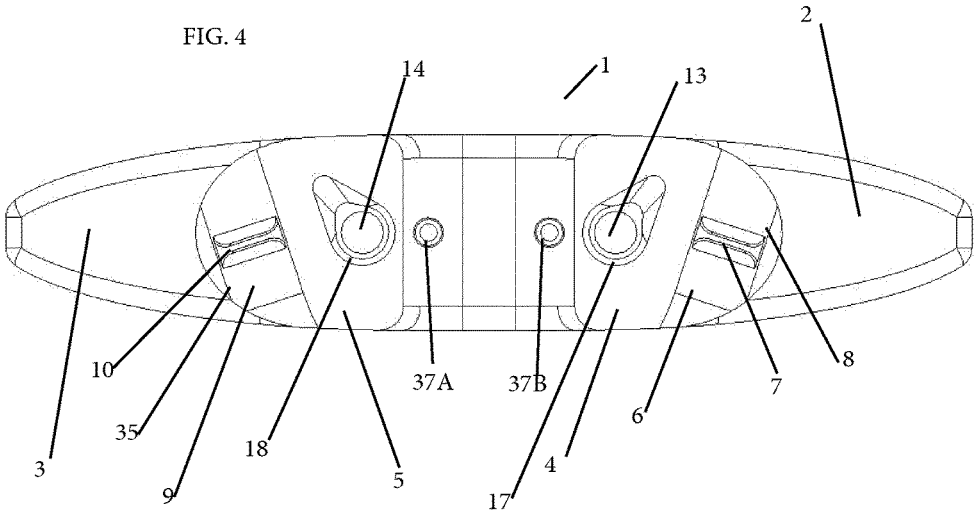
FIG. 4 is a bottom plan view of the novel cleat, support structures, aligning recesses, and recess of the support structure.
Figure 5:
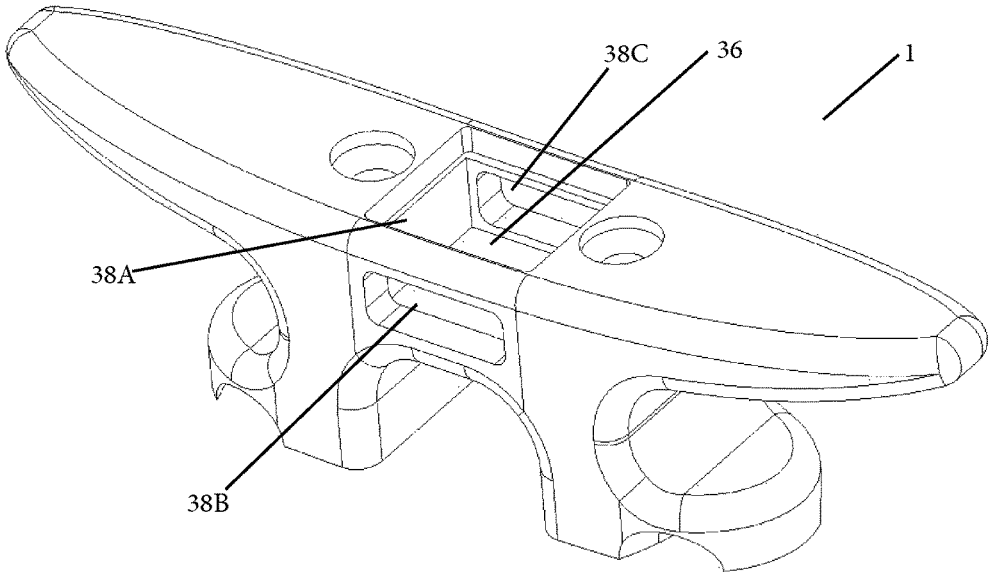
FIG. 5 is a perspective view of the novel cleat having a compartment and compartment openings.
Figure 6:
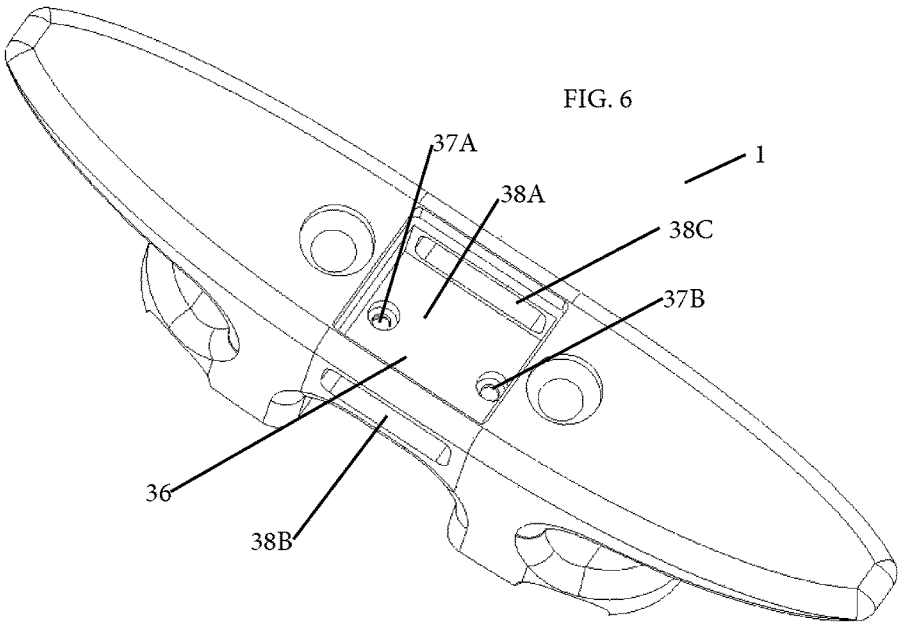
FIG. 6 is a top perspective view of the novel cleat having a compartment and compartment openings.
Figure 11:
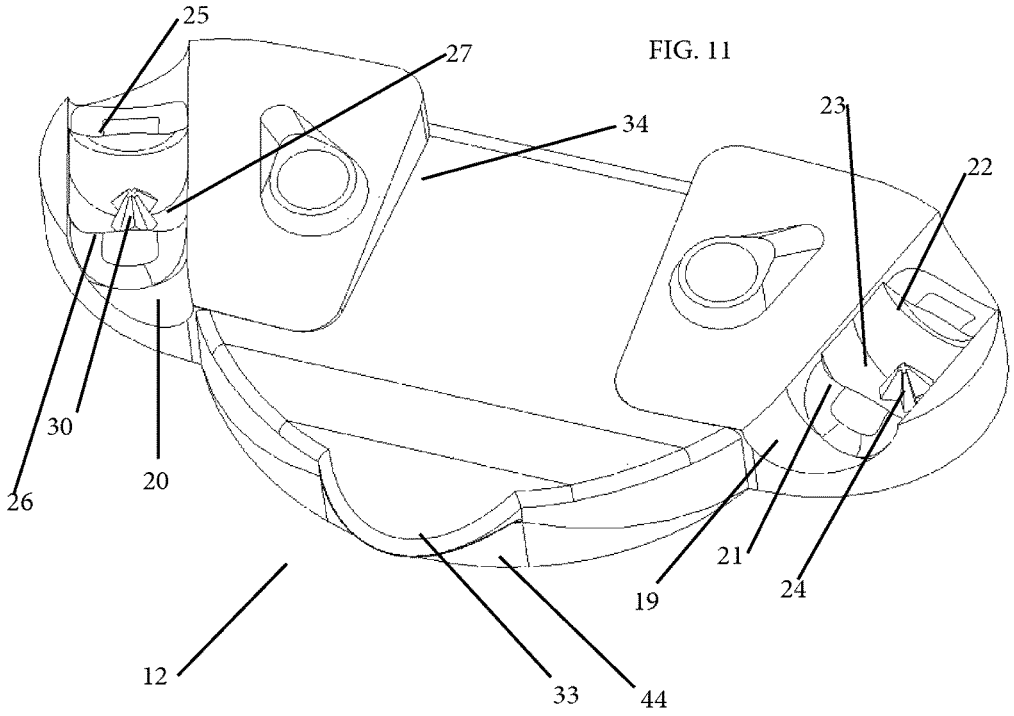
FIG. 11 is a perspective view of the base having a radial guide and a projecting structure.

In a general embodiment, FIGS. 1, 2, and 4 show novel cleat 1 having primary horn 2 located opposite secondary horn 3. Cleat 1 has primary support structure 4 (FIGS. 1, 2, and 4) and secondary support structure 5 (FIGS. 1, 2, and 4). Primary support structure 4 has primary recess 6. Primary ridge 7 is connected to wall surface 8 of primary recess 6. Secondary support structure 5 has secondary recess 9. Secondary ridge 10 is connected to wall surface 35 of secondary recess 9. Cleat 1 has tertiary recess 11 (FIGS. 1, 2, and 11).

Referring now to FIGS. 3, 5, 6, 14, and 16-17 it will be seen that the reference numeral 36 illustrates compartment 36 of cleat 1. Compartment 36 has primary compartment opening 38A, primary fastener opening 37A (FIGS. 2-4, 6, and 16-17), and secondary fastener opening 37B (FIGS. 2-4, 6, and 16-17). Cleat 1 has primary cleat bore 13 (FIGS. 3-6 and 16) and secondary cleat bore 14 (FIGS. 3-6, and 16). Compartment 36 has at least one opening. In a preferred embodiment, compartment 36 has primary compartment opening 38A, secondary compartment opening 38B (FIGS. 5-6, 14 and 16-17), and tertiary compartment opening 38C (FIGS. 5-6, 14 and 16-17).

Figure 16:
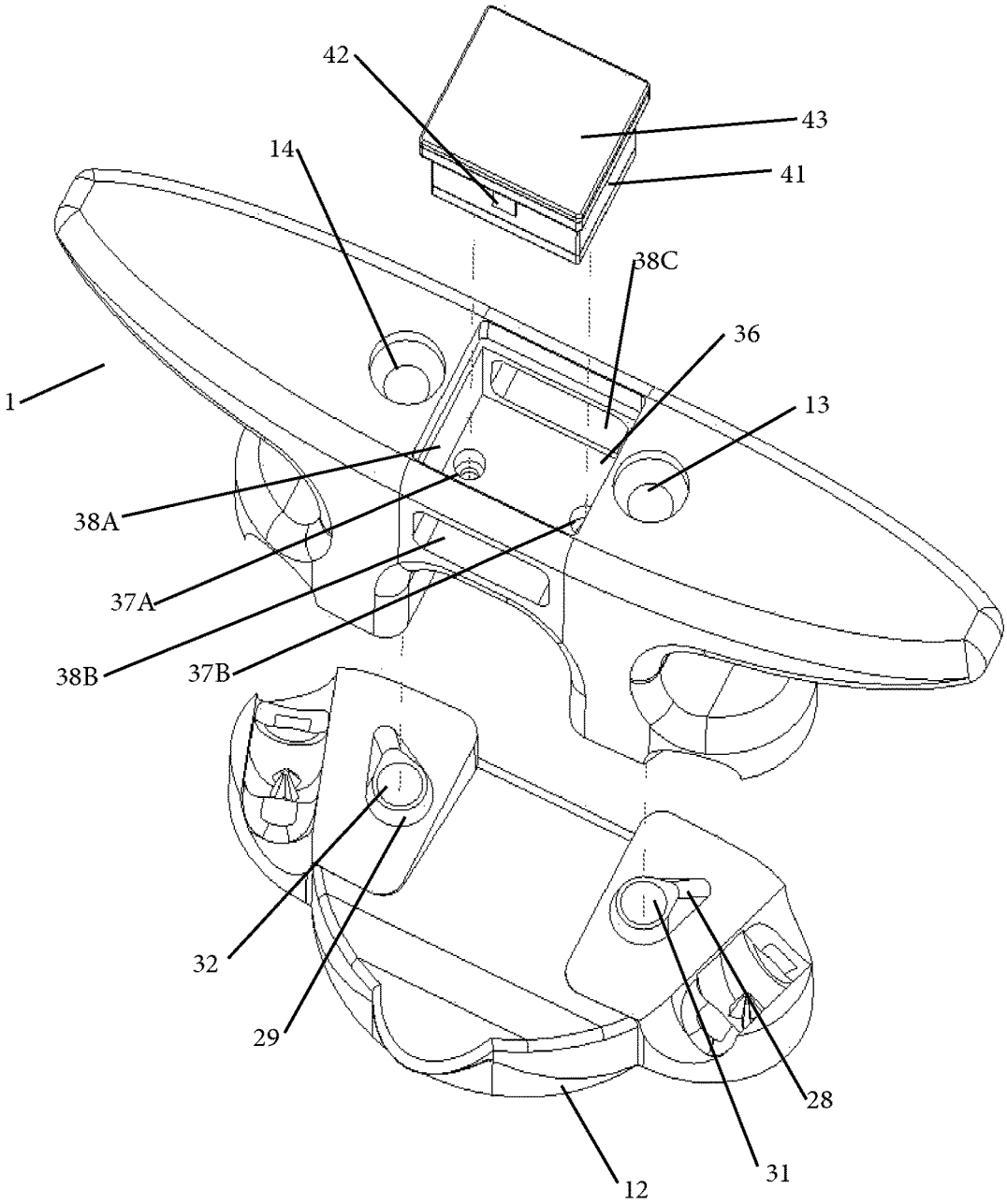
FIG. 16 is an exploded view of the cleat having a compartment configured to retain a housing having a light emitting unit, the cleat is removably connected to a base.
Figure 17:
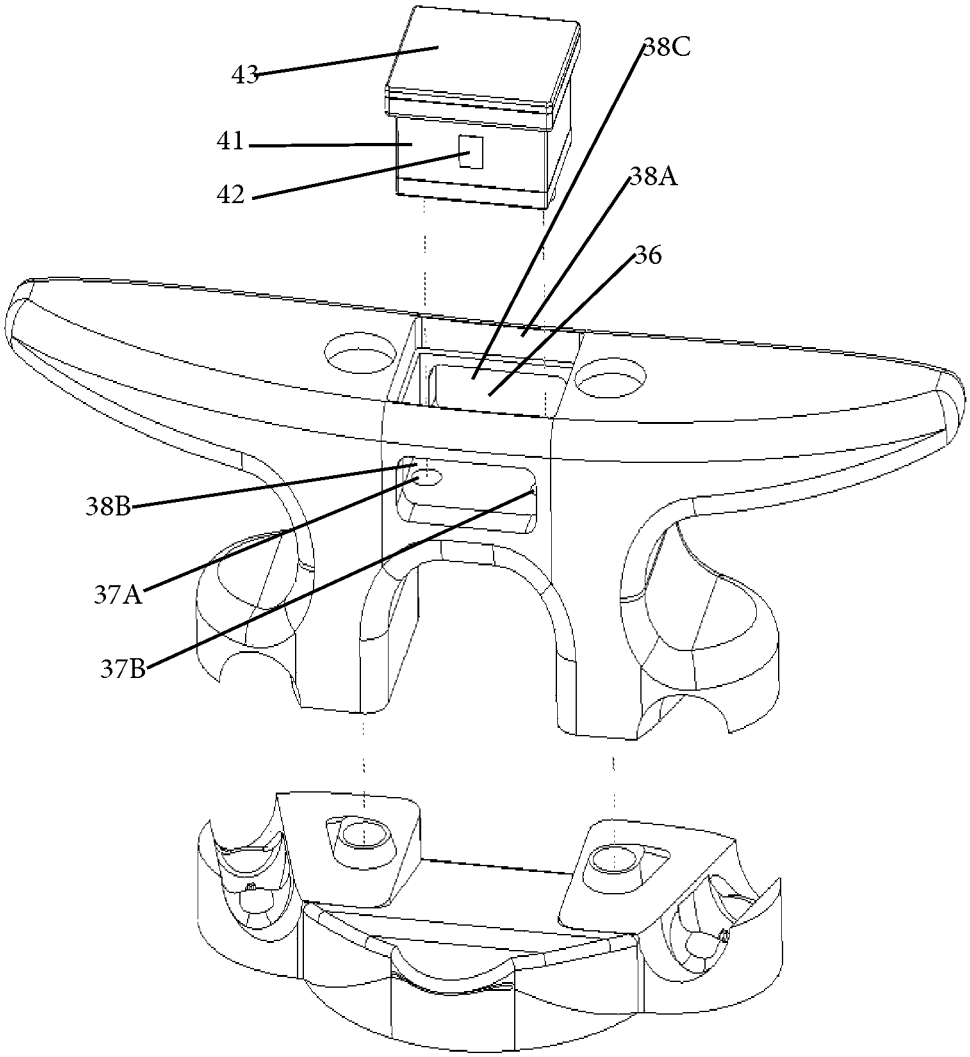
FIG. 17 is an exploded view of the cleat having a compartment configured to retain a housing having a light emitting unit, the cleat is removably connected to a base.
Figure 18:
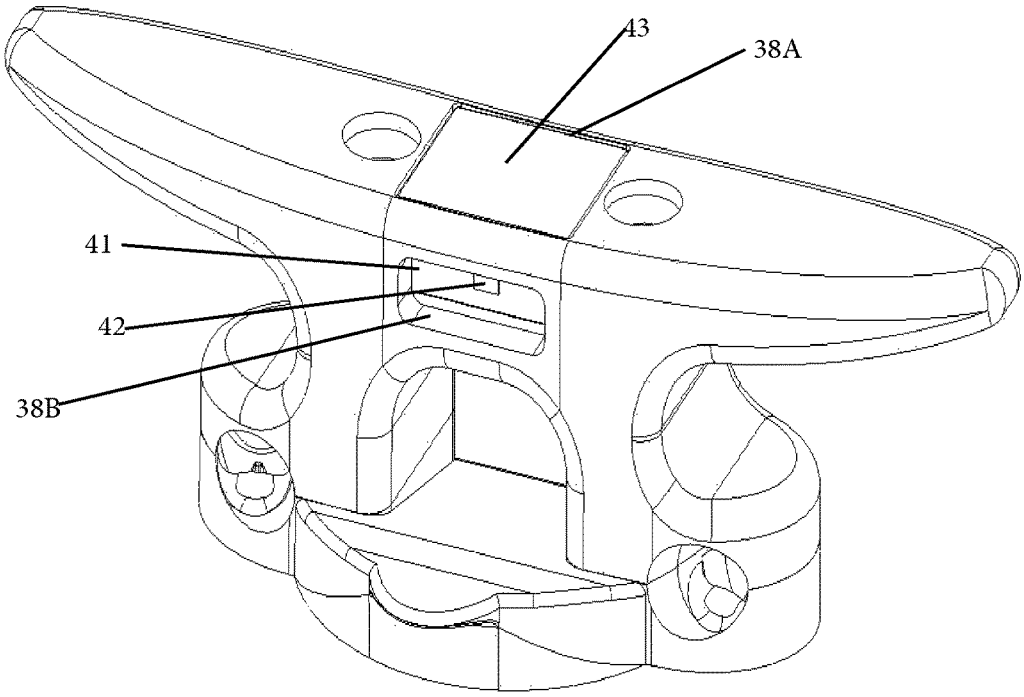
FIG. 18 is a perspective view of the cleat having a light emitting unit, the cleat is connected to a base.

FIGS. 16-18 show compartment 36 is configured to retain housing 41 having light emitting unit 42. It is within the scope of this invention for light emitting unit 42 to be powered with at least one solar cell 43. FIG. 18 illustrates cleat 1 connected to base 12. Cleat 1 has at least one solar cell 43 positioned in at least one opening 38A, 38B or 38C of compartment 36.

Figure 7:
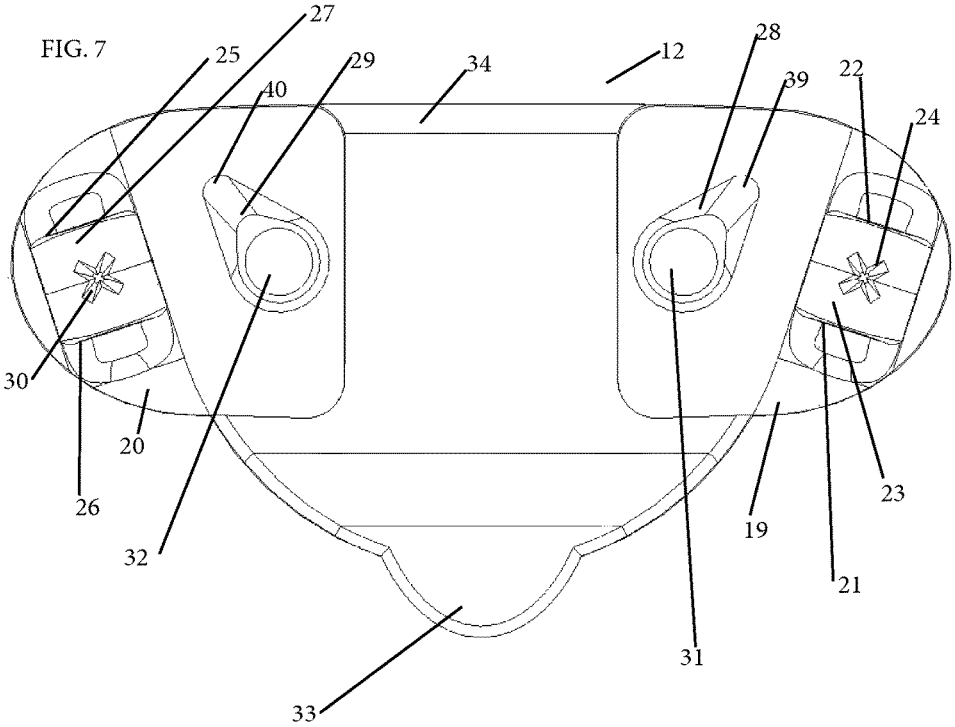
FIG. 7 is a top perspective view of the base having a projecting structure and an aligning protrusion.
Figure 8:
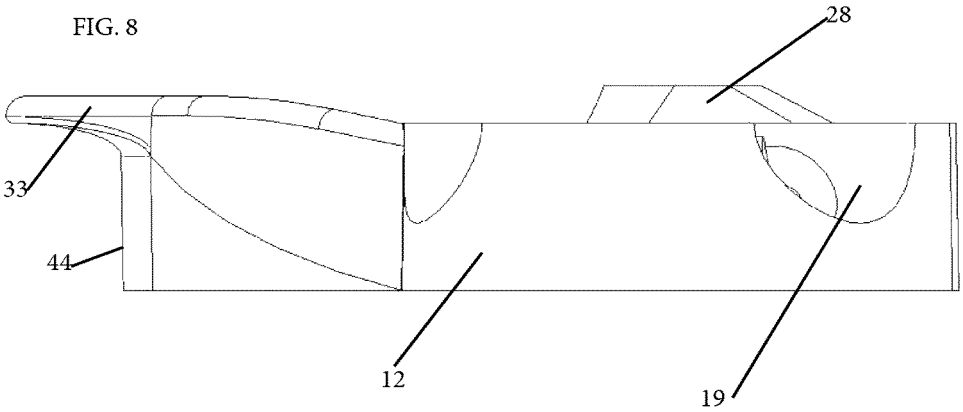
FIG. 8 is a side perspective view of the base having a projecting structure and an aligning protrusion.
Figure 9:
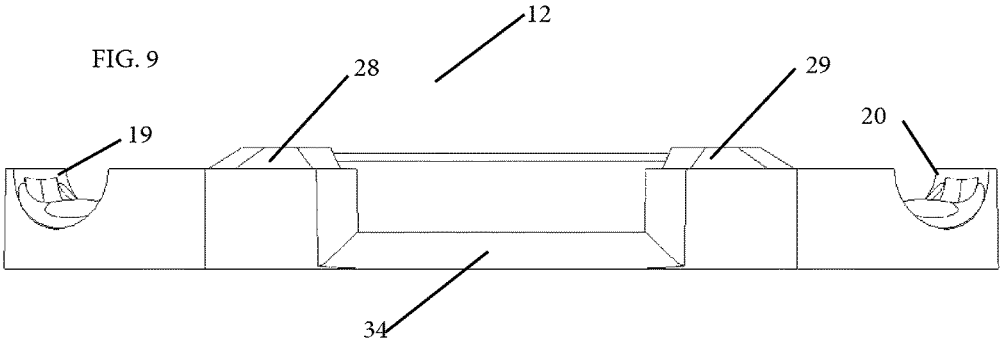
FIG. 9 is a side perspective view of the base having a tapered wall surface and aligning protrusions.
Figure 10:
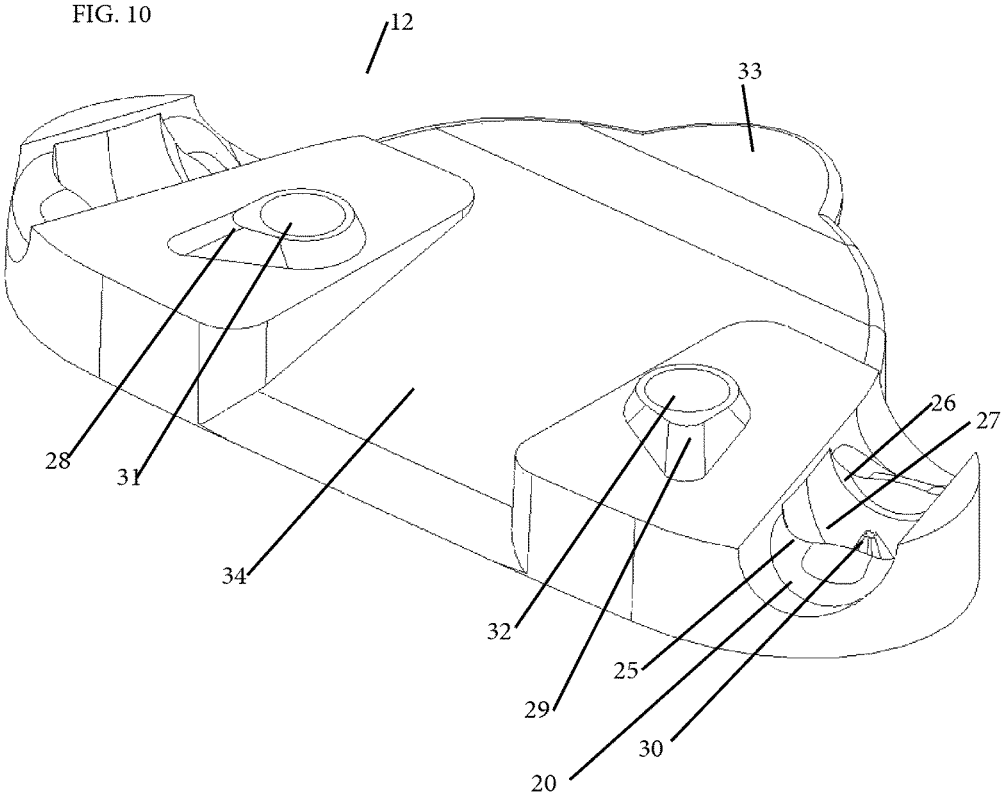
FIG. 10 is a perspective view of the base having a projecting structure, aligning protrusions, a tapered wall surface, and at least one recess.
Figure 12:
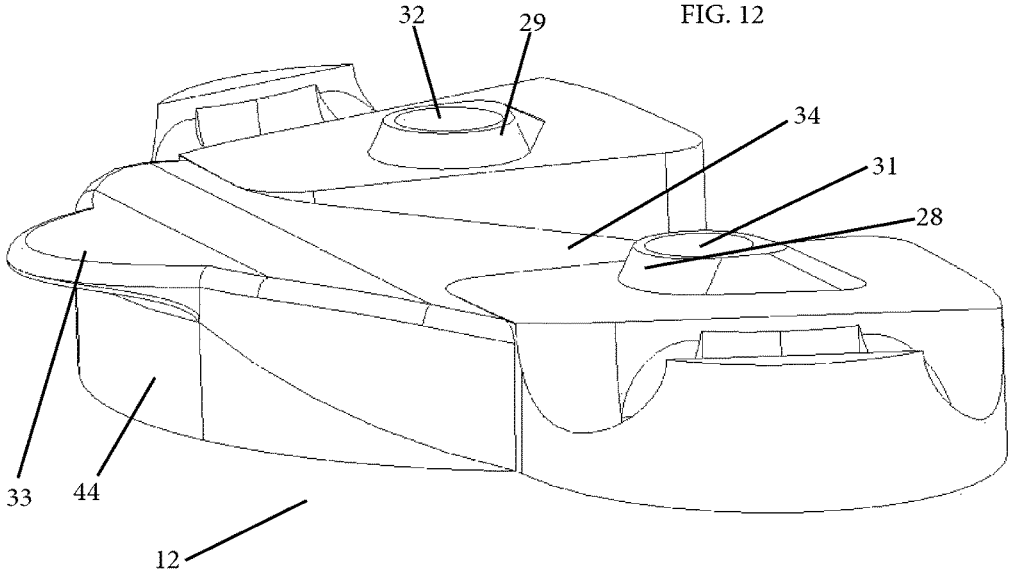
FIG. 12 is a perspective view of the base having a radial guide and a projecting structure.

FIG. 4 depicts cleat 1 having an alignment structure, whereby, primary support structure 4 has primary aligning recess 17 and secondary support structure 5 has secondary aligning recess 18. FIGS. 7-8 and 16 illustrate base 12 having an alignment structure, whereby, primary aligning protrusion 28 and secondary aligning protrusion 29 are connected to a surface of base. It is within the scope of this invention for the aligning protrusion 28 (FIGS. 7-10 and 12) to boarder a perimeter of bore 31 (FIGS. 7, 10, 12, and 16) and aligning protrusion 29 (FIGS. 7, 9-10, 12, and 16) to boarder a perimeter of secondary bore 32 (FIGS. 7, 10, and 12). It is within the scope of this invention for the recess to have a tapered configuration, whereby, the primary tapered end 39 of primary aligning protrusion 28 (FIG. 7) radiates in a direction opposite the secondary tapered end 40 of secondary aligning protrusion 29 (FIG. 7).

Figure 13:
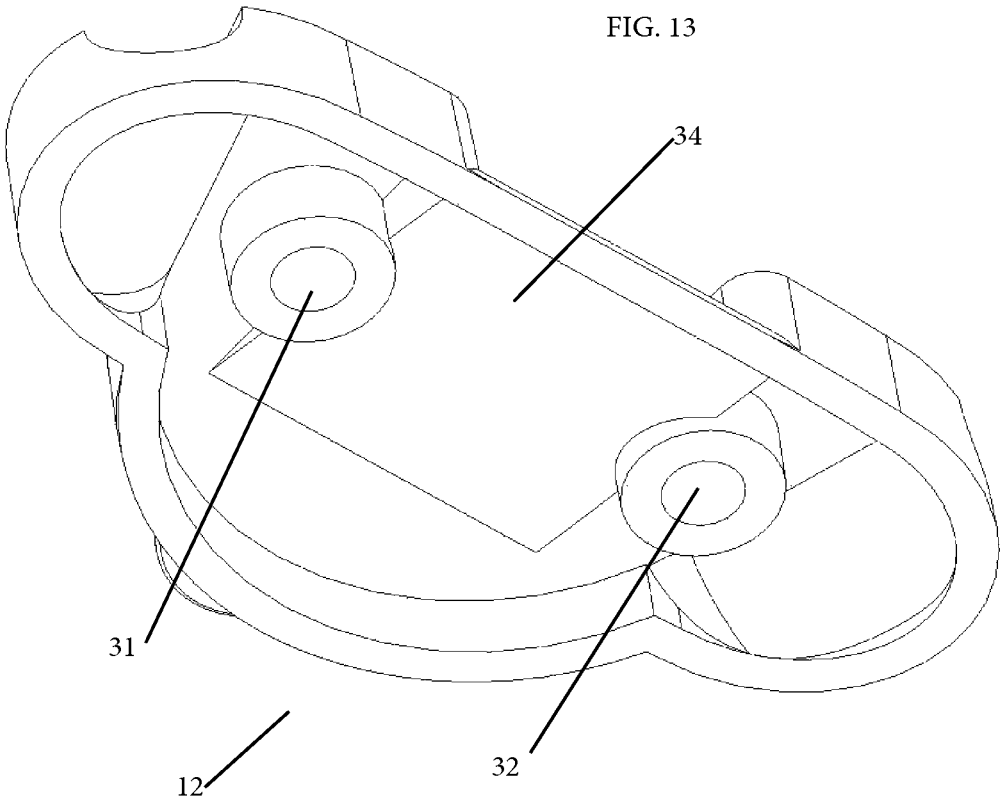
FIG. 13 is a bottom perspective view of the base having a primary bore, a secondary bore, and a tapered wall surface.

FIGS. 7 and 11 depict base 12 having primary recess 19 (FIGS. 7-9 and 11). Primary recess 19 has primary ramp 21 and secondary ramp 22 forming primary pocket 23. Primary pocket 23 has at least one protrusion 24. FIGS. 7 and 10-11 illustrate base 12 having secondary recess 20 (FIGS. 7 and 9-11) having tertiary ramp 25 and quaternary ramp 26 forming secondary pocket 27. Secondary pocket 27 has at least one protrusion 30. In an alternate embodiment, base 12 can have tapered wall surface 34 (FIGS. 7, 9-13, and 15). In another embodiment illustrated in FIGS. 7-8 and 10-12, base 12 can have projecting structure 33. FIGS. 7 and 12-13 illustrate base 12 having primary bore 31 and secondary bore 32.

FIGS. 8, 11-12, and 14 illustrate base 12 having radial guide 44 and projecting structure 33.

Figure 14:
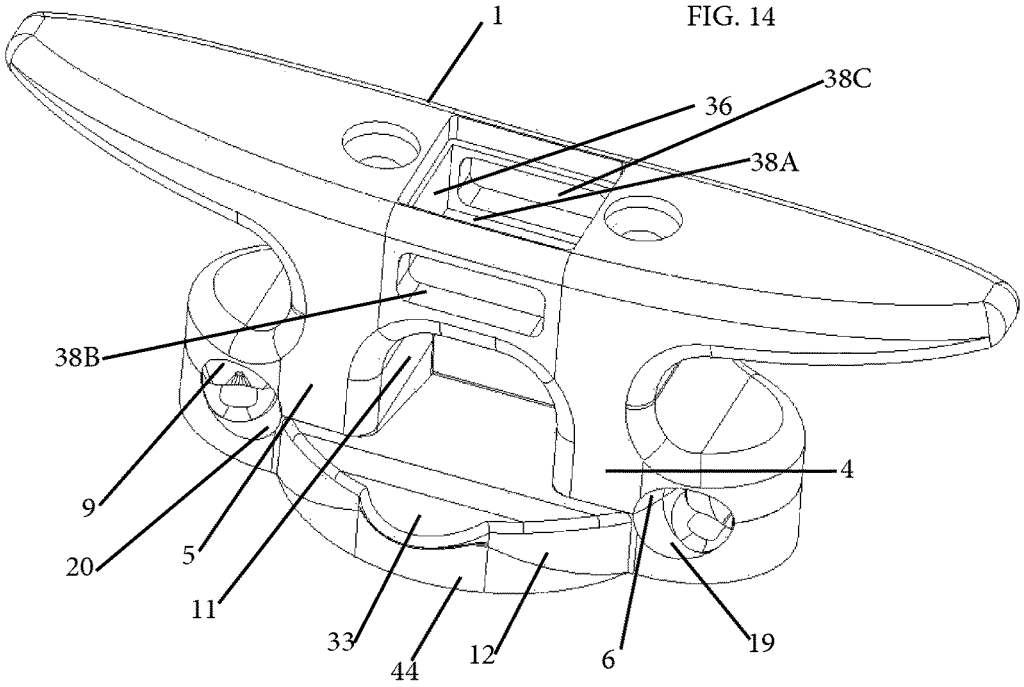
FIG. 14 is a front perspective view of the cleat connected to a base having a projecting structure and a radial guide.
Figure 15:
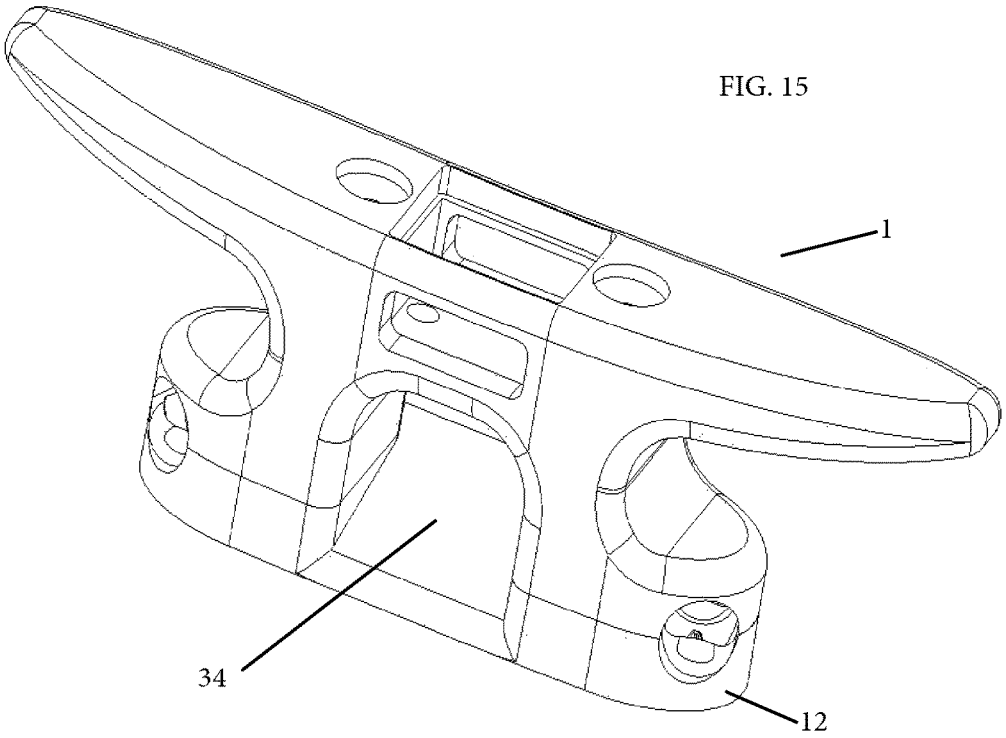
FIG. 15 is a rear perspective view of the cleat connected to a base having a tapered wall surface.

FIGS. 14 and 15 shows cleat 1 being removably connected to base 12. FIG. 14 shows primary recess 6 of primary support structure 4 is oriented over primary recess 19 of base 12. Secondary recess 9 of secondary support structure 5 is oriented over secondary recess 20 of base 12.

Figure 19:
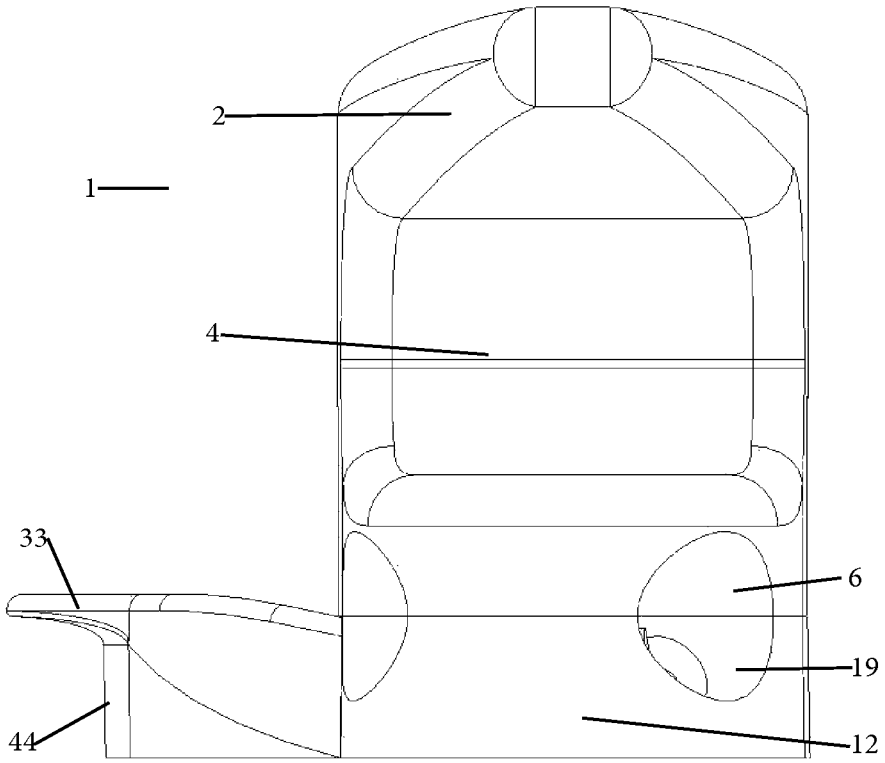
FIG. 19 is a side perspective view of the radial guide having a projecting structure.

Referring now to FIG. 19, cleat 1 has horn 2 connected to primary support structure 4. Primary support structure 4 has primary recess 6. Base 12 has primary recess 19. Radial guide 44 has projecting structure 33.

Figure 20:
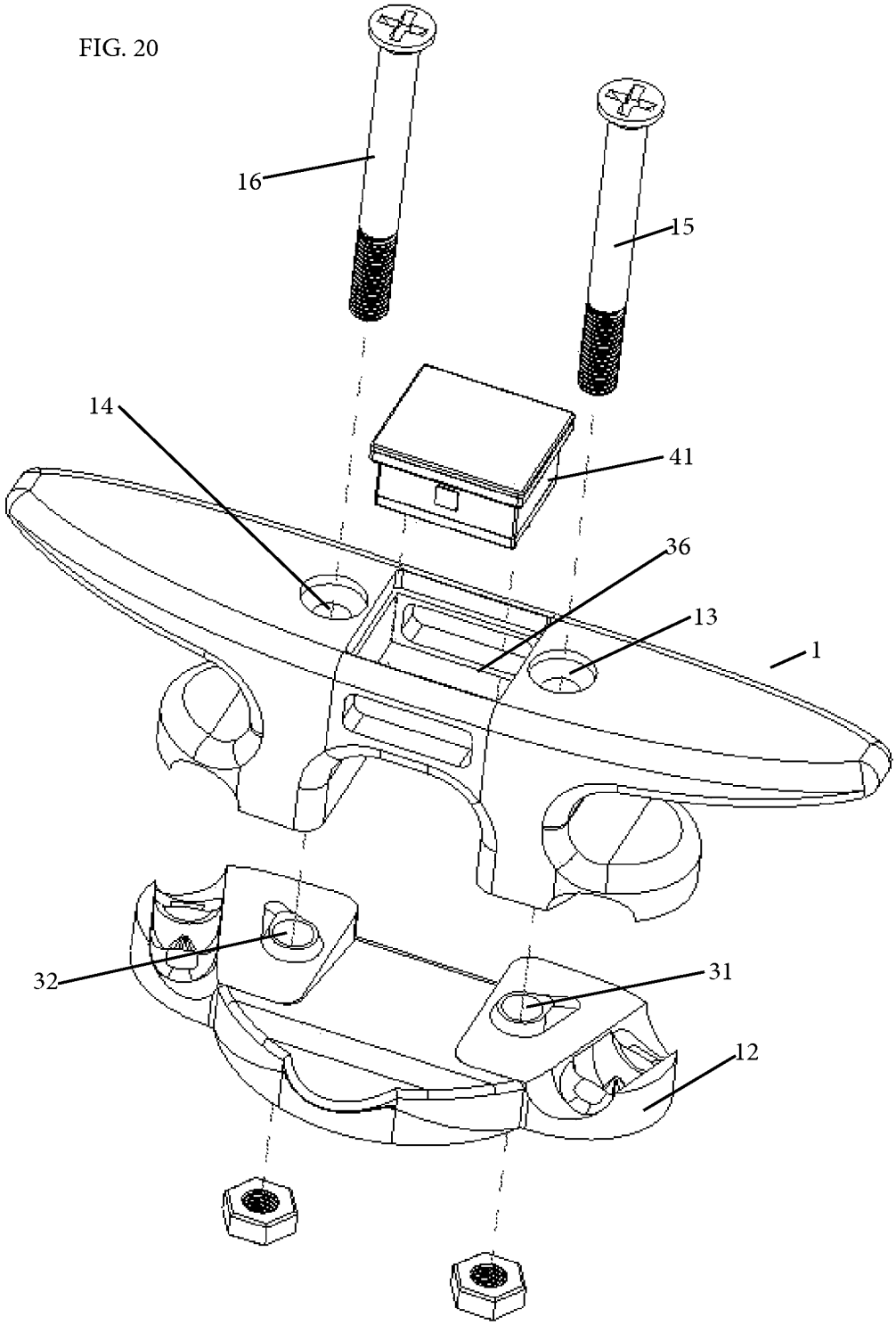
FIG. 20 is an exploded perspective view of the fasteners aligning with a bore of the cleat and a bore of the base, the housing aligning with an opening of the compartment.
Figure 21:
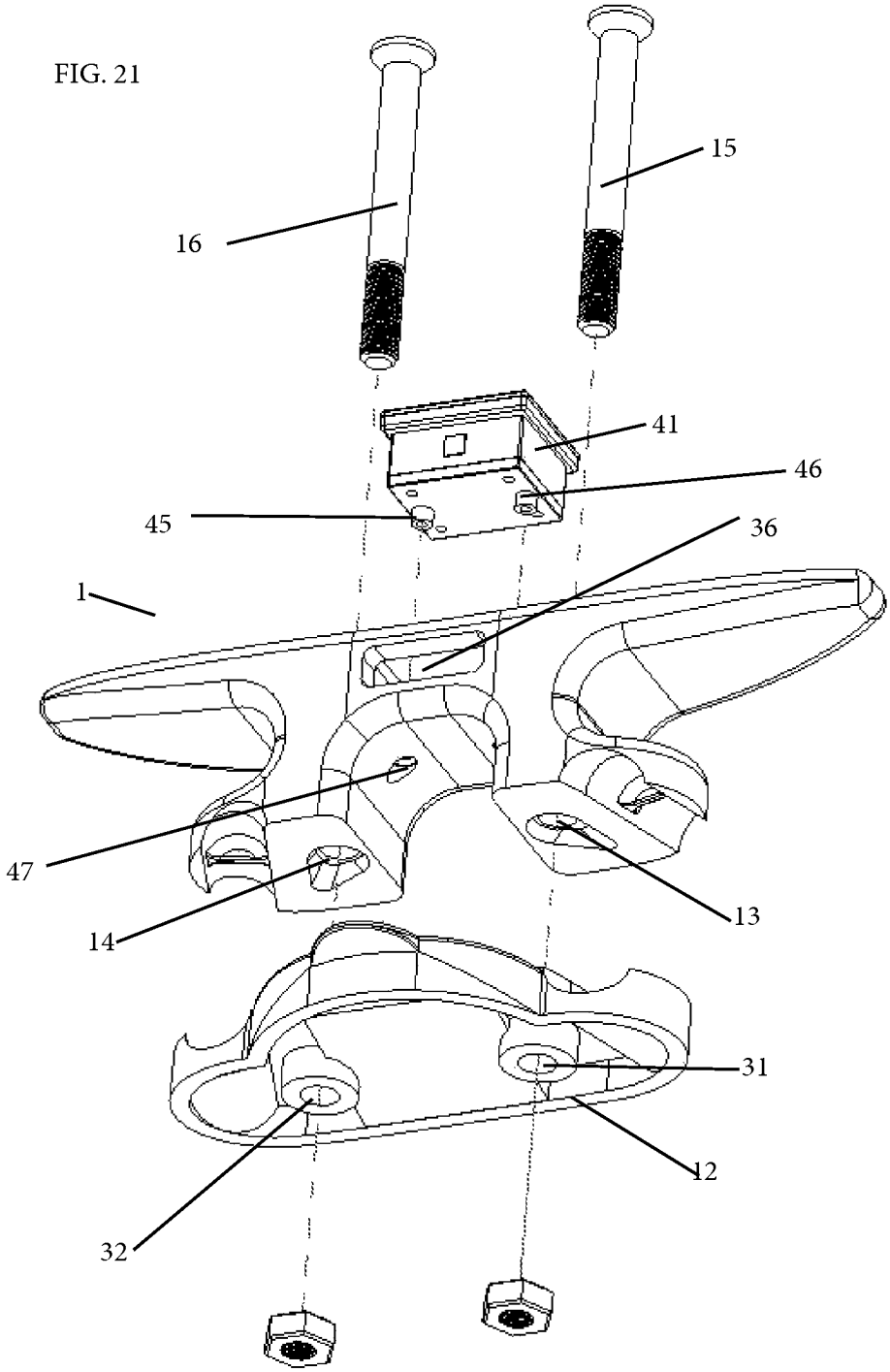
FIG. 21 is an exploded perspective view of the fasteners aligning with a bore of the cleat and a bore of the base, the housing aligning with an opening of the compartment.
Figure 22:
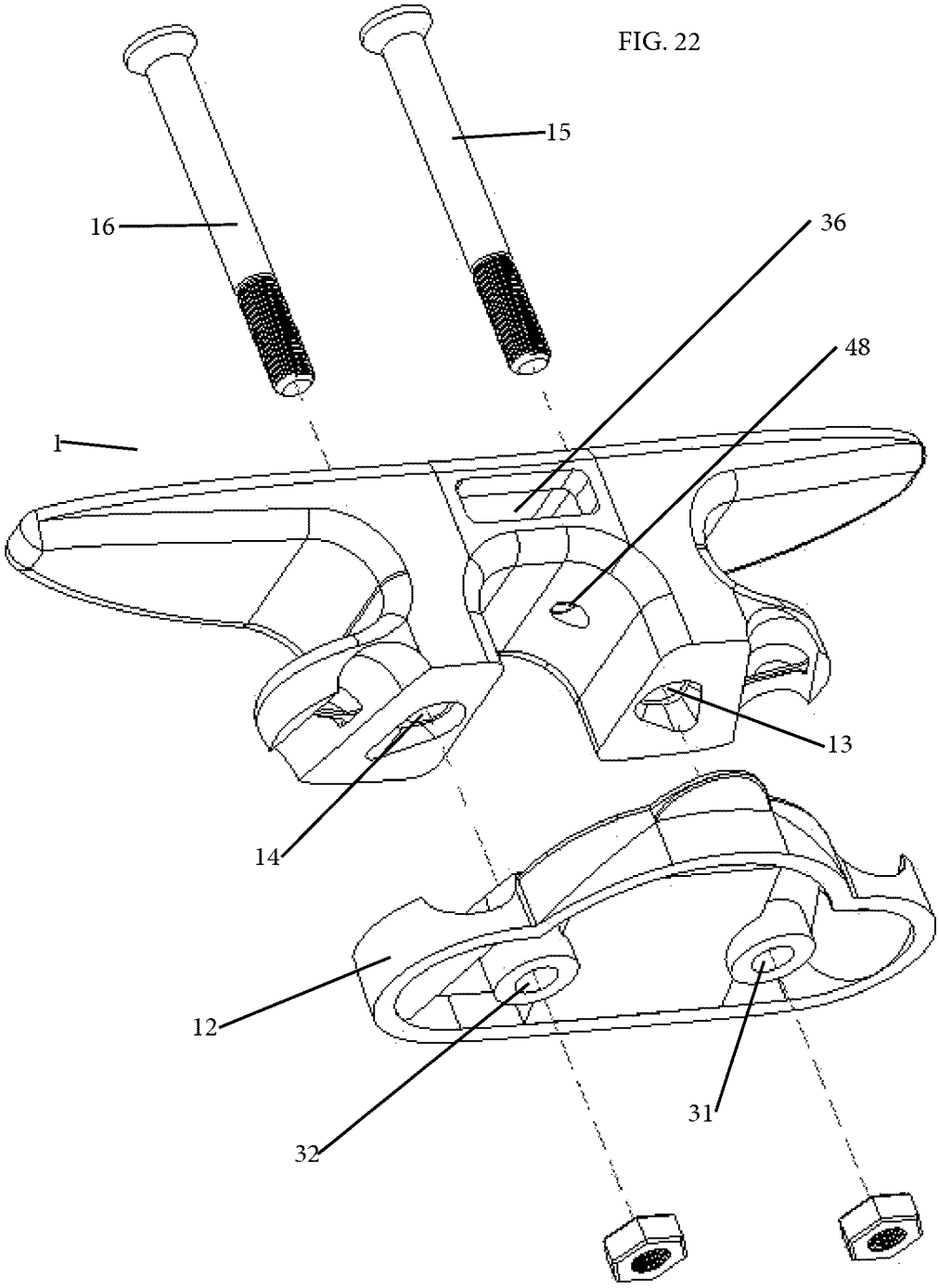
FIG. 22 is an exploded perspective view of the fasteners aligning with a bore of the cleat and a bore of the base, the housing aligning with an opening of the compartment.
Figure 23:
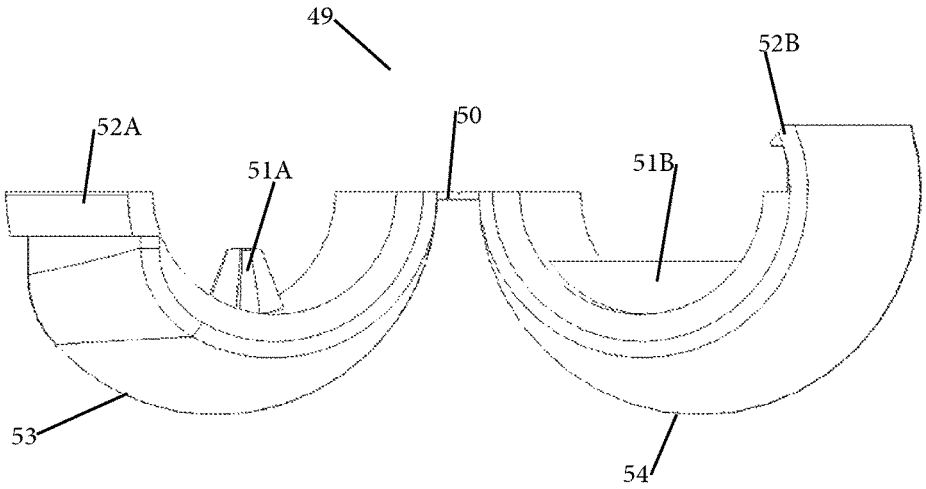
FIG. 23 is a side perspective view of the retaining member in an open configuration, a primary portion is connected to a secondary portion by a hinge.
Figure 24:
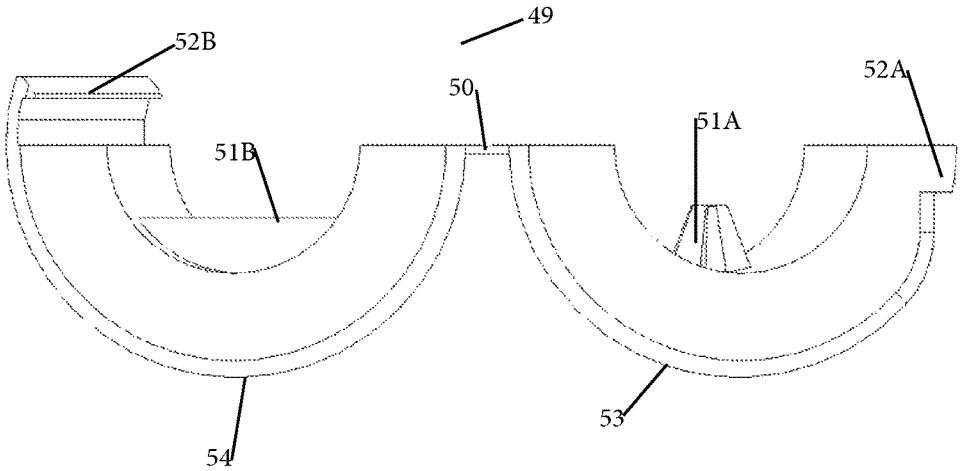
FIG. 24 is a side perspective view of the retaining member in an open configuration, a primary portion is connected to a secondary portion by a hinge.
Figure 25:
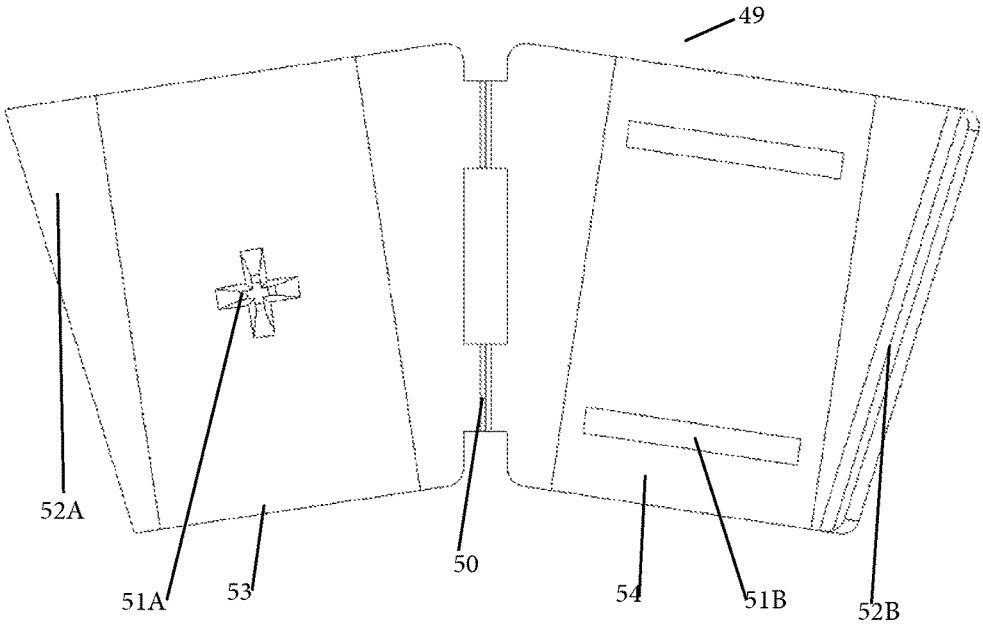
FIG. 25 is a top perspective view of the retaining member in an open configuration, a portion of the retaining member having a protrusion.
Figure 26:
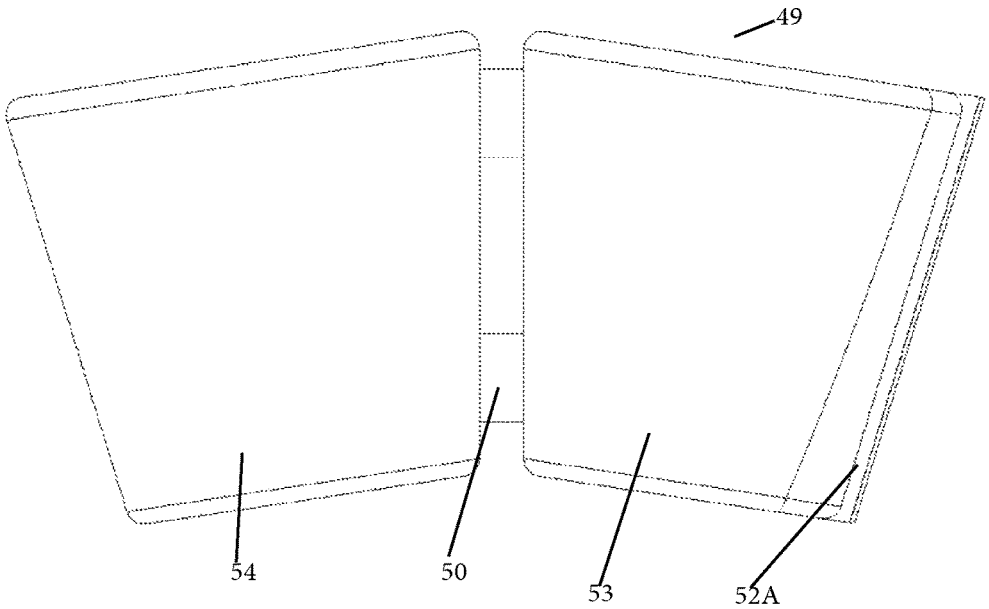
FIG. 26 is a bottom perspective view of the retaining member in an open configuration.
Figure 27:
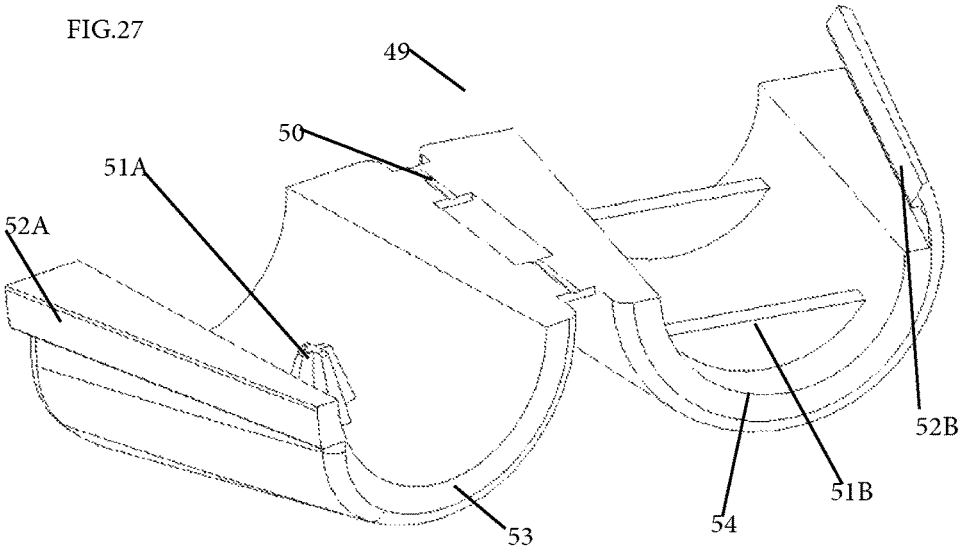
FIG. 27 is a perspective view of the retaining member in an open configuration having protrusions and a latching structure.
Figure 28:
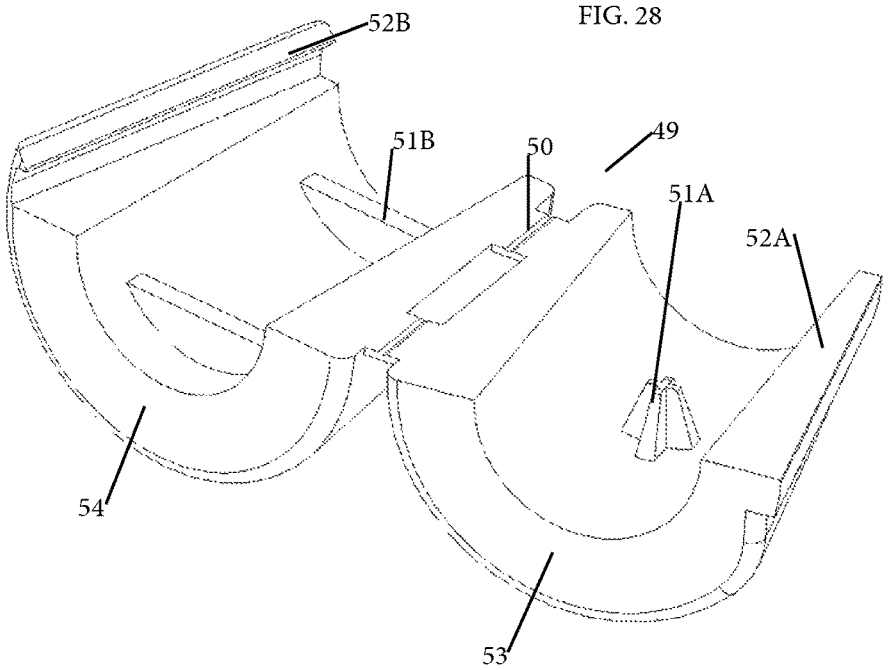
FIG. 28 is a perspective view of the retaining member in an open configuration having protrusions and a latching structure.
Figure 29:
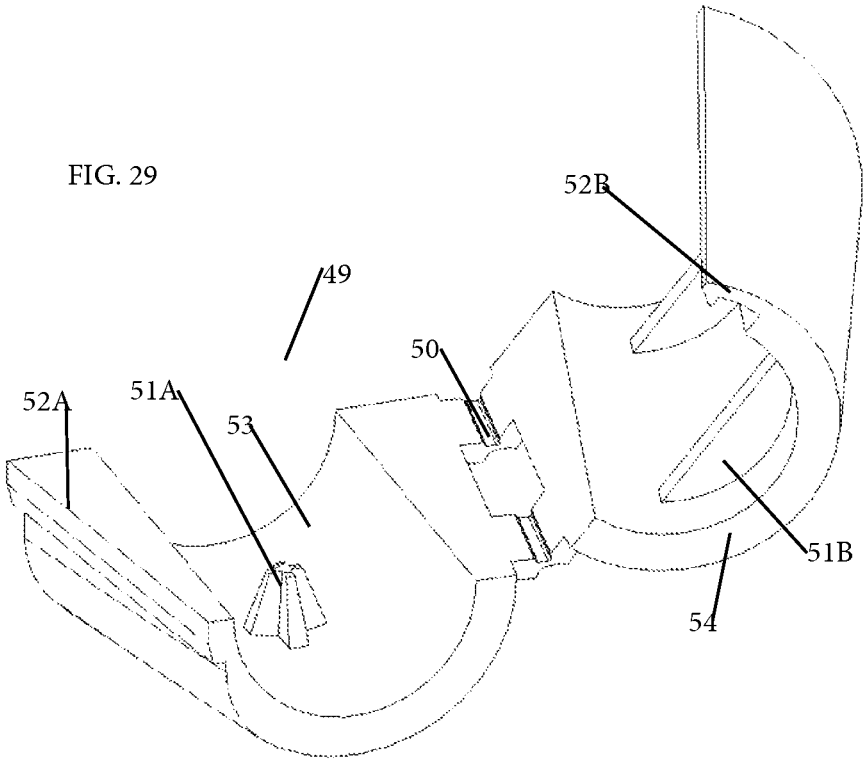
FIG. 29 is a perspective view of the retaining member having protrusions and a latching structure.
Figure 30:
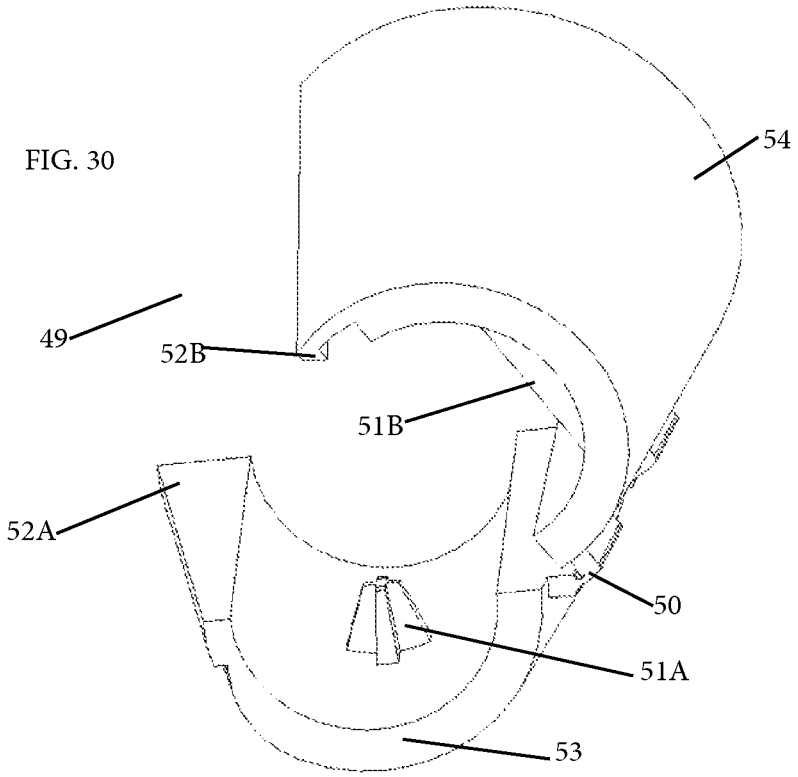
FIG. 30 is a perspective view of the retaining member having protrusions and a latching structure.
Figure 31:
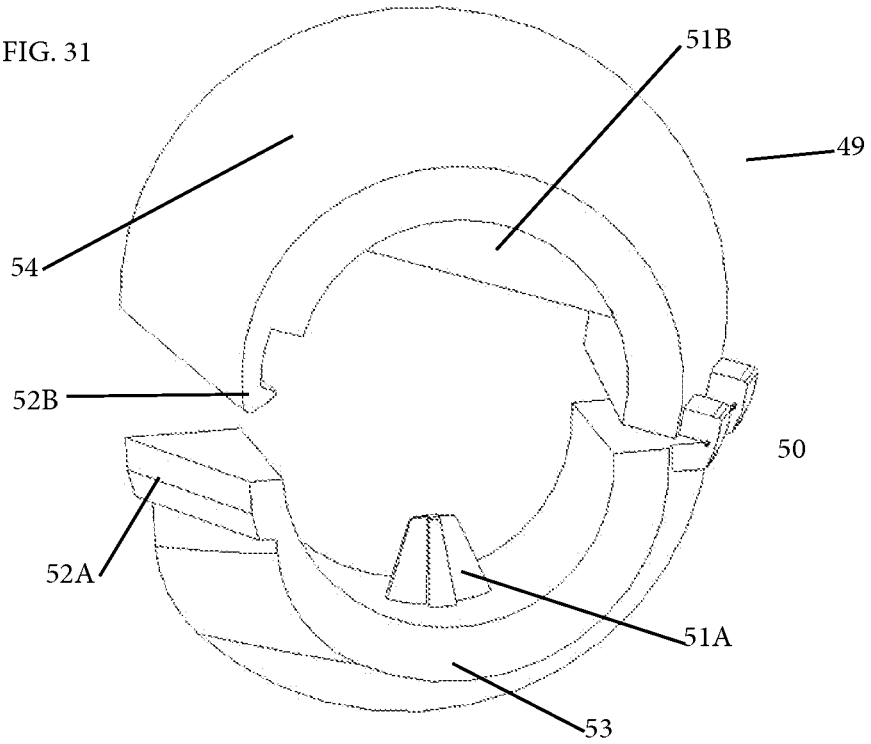
FIG. 31 is a perspective view of the retaining member having protrusions and a latching structure.
Figure 32:
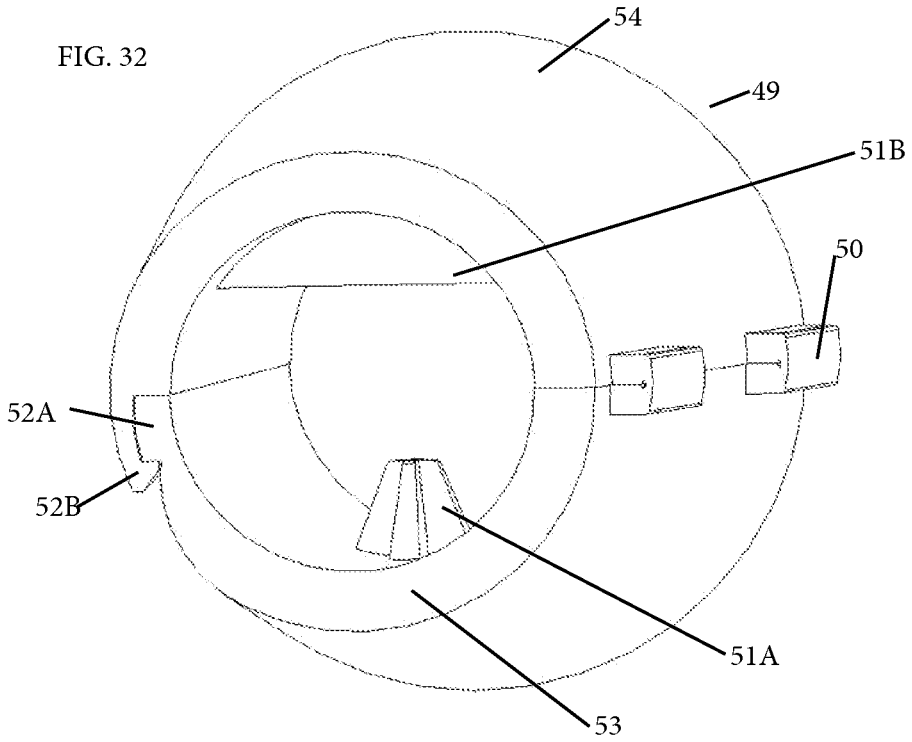
FIG. 32 is a perspective view of the retaining member in a closed configuration having protrusions and a latching structure.
Figure 33:
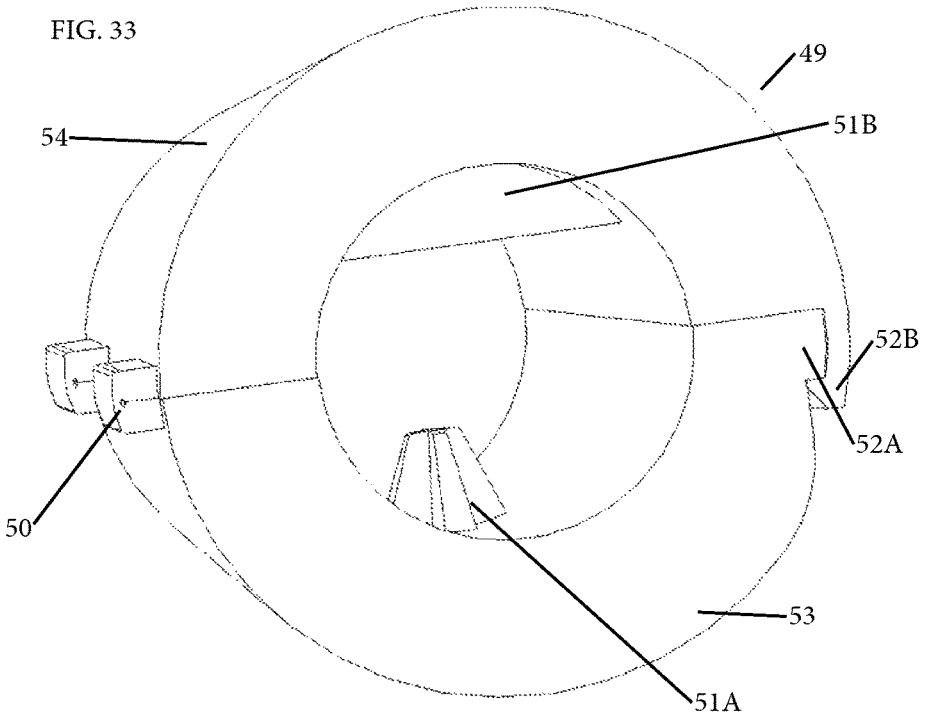
FIG. 33 is a perspective view of the retaining member in a closed configuration having protrusions and a latching structure.
Figure 34:
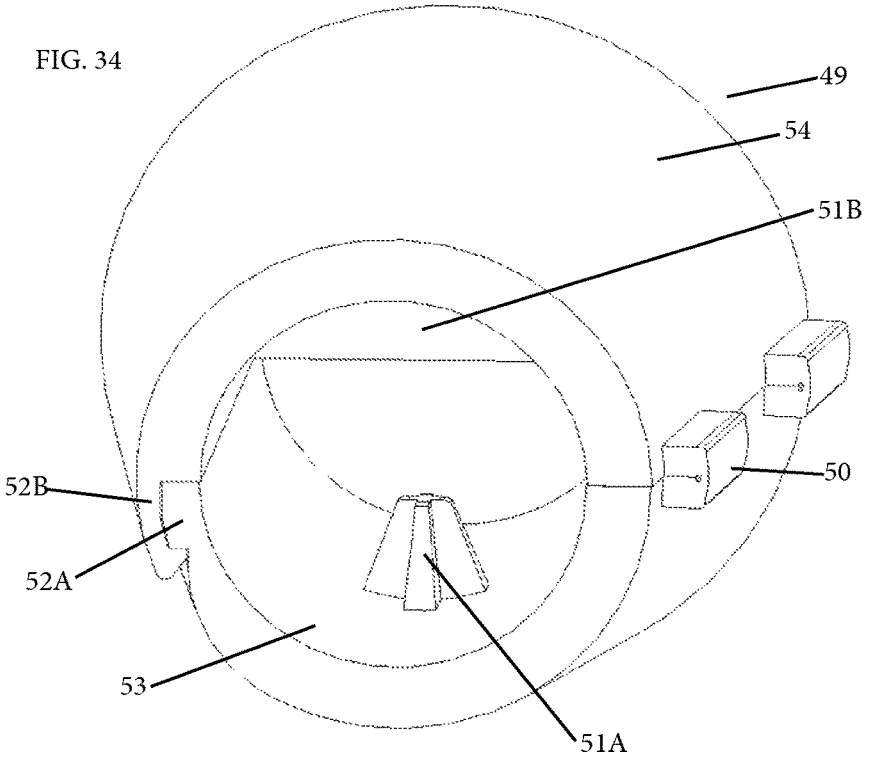
FIG. 34 is a perspective view of the retaining member in a closed configuration having protrusions and a latching structure.

FIGS. 20-22 best illustrate primary fastener 15 being inserted through primary bore 13 of cleat 1 and then being inserted through primary bore 31 of base 12. Secondary fastener 16 is inserted through secondary bore 14 of cleat 1 and is then inserted through secondary bore 32 of base 12. Housing 41 is retained by compartment 36 of cleat 1. FIG. 21 shows housing 41 having primary housing protrusion 45 and secondary housing protrusion 46. Compartment 36 of cleat 1 can have primary compartment bore 47 that receives primary housing protrusion 45, thereby, retaining housing 41 within compartment 36. Compartment 36 of cleat 1 can have secondary compartment bore 48 (FIG. 22) that receives secondary housing protrusion 46, thereby, retaining housing 41 within compartment 36.

FIGS. 23-34 depict retaining member 49 having primary portion 53 connected to secondary portion 54 by hinge 50. Primary portion 53 of retaining member 49 has at least one protrusion 51A and latching structure 52A. Secondary portion 52 of retaining member 49 has at least one protrusion 51B and latching structure 52B.

Figure 35:
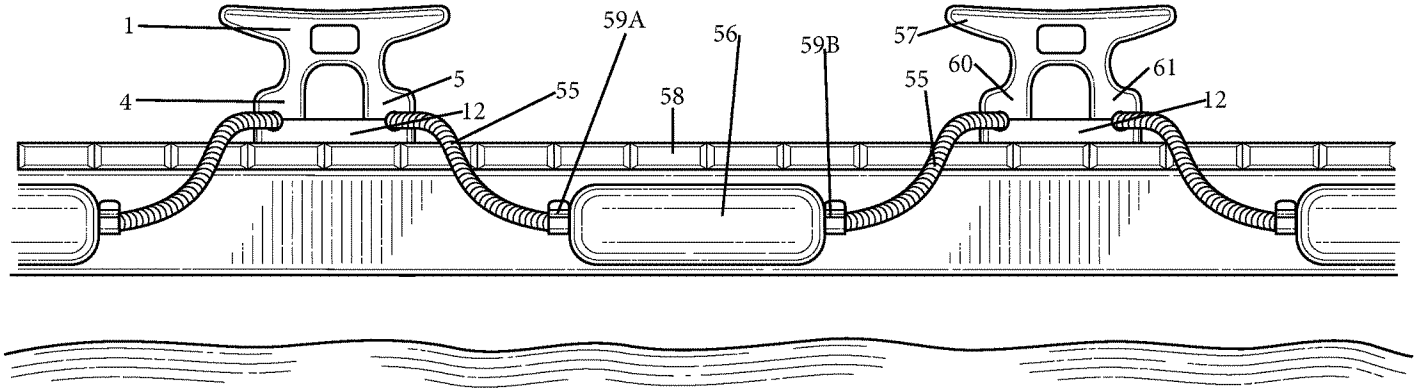
FIG. 35 is a side plan view of the bumper being suspended by a cleat anchoring system; and, FIG. 36 is a top plan view of the bumper being suspended by a cleat anchoring system.
Figure 36:
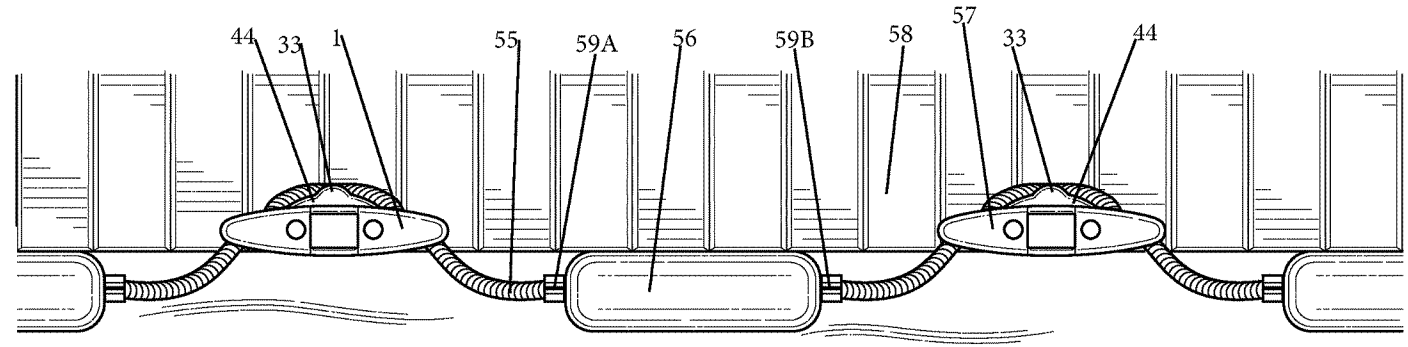

FIGS. 35-36 show bumpers 56A, 56B, and 56C being suspended by length of material 55. A portion of length of material 55 is placed between support structure 5 associated with a recess of primary cleat 1 and an anchoring surface. An anchoring surface can be base 12, a dock 58, a vessel, or a seawall. In alternate embodiment, primary cleat 1 and secondary cleat 57 can connect directly to the dock and to not require base 12. The length of material 55 can be placed between the support structure 5 associated with a recess of primary cleat 1 and a dock. FIG. 36 best shows a user (not shown) passing a portion of length of material 55 over radial guide 44 having projecting structure 33. The user (not shown) then places a portion of length of material 55 between support structure 4 associated with another recess of primary cleat 1 and an anchoring surface.

Another portion of length of material 55 is placed between support structure 60 associated with a recess of secondary cleat 57 and an anchoring surface including, but not limited to, base 12, a dock 58, a vessel, or a sea wall. Secondary cleat 57 has secondary support structure 61. FIGS. 35-36 illustrate retaining member 59A being attached to length of material 55 located on a side of bumper 56 to limit the movement of bumper 56 from traversing length of material 55. Another retaining member 59*b* is attached to length of material 55 located on an opposite side of bumper 56 to limit the movement of bumper 56 from traversing length of material 55.

Figure 37:
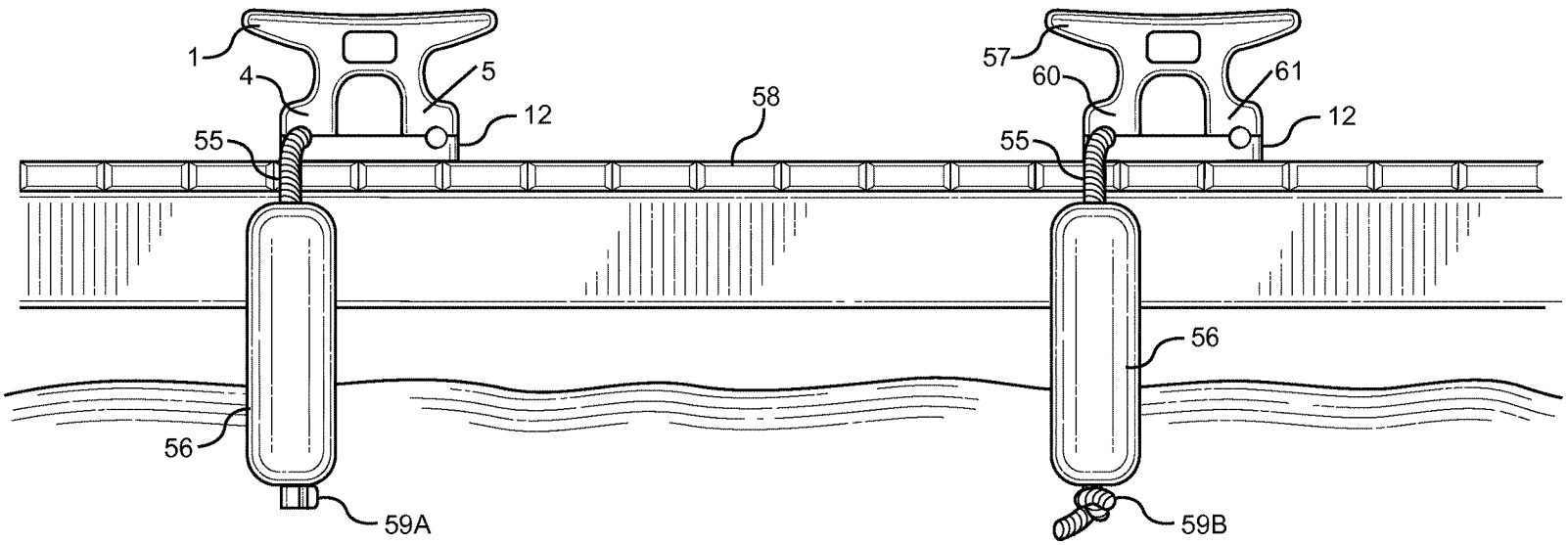
FIG. 37 is a side plan view of an alternate embodiment of the bumper being suspended by a cleat anchoring system having a retaining member being a clip and a knot.

FIG. 37 illustrates retaining member 59B being a clip and retaining member 59B being a knot. A portion of rope 55 is positioned between a support structure 4 of cleat 1 and base 12. Bumper 56 is suspended from rope 55. Another portion of rope 55 is positioned between a support structure 66 of cleat 57 and base 12.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

The invention claimed is:

1. A cleat, comprising:

a first horn located opposite a second horn;

at least one support structure connected to said cleat, said at least one support structure having at least one recess, whereby, at least one protrusion protrudes from a wall surface of said at least one recess of said at least one support structure, said at least one protrusion is configured to deform a portion of a length of material;

said at least one support structure having a bore, said bore of said at least one support structure is configured to receive a fastener; and, a base having a bore configured to receive said fastener, whereby, said bore of said at least one support structure is oriented to align with said bore of said base, said base having at least one recess, said base having at least two ramps protruding from a wall surface of said at least one recess of said base, whereby, said at least two ramps are oriented to form a pocket.

2. The cleat of claim 1, further comprising said cleat having a light emitting unit.

3. The cleat of claim 1, further comprising said cleat having at least one compartment, said at least one compartment containing a light emitting unit.

4. The cleat of claim 1, further comprising a power storage device.

5. The cleat of claim 4, further comprising said power storage device being rechargeable by at least one solar cell, said at least one solar cell positioned in at least one opening of at least one compartment of said cleat.

6. The cleat of claim 1, further comprising said base having a tapered wall surface.

7. The cleat of claim 1, further comprising said base having a radial guide, said radial guide having a projecting structure configured to retain a portion of said length of material on said radial guide.

8. The cleat of claim 1, further comprising, said pocket having at least one protrusion, said at least one protrusion is configured to bind a portion of said length of material when said fastener is tightened.

9. The cleat of claim 1, further comprising at least one support structure having an alignment structure configured to mate with a mirroring alignment structure formed on said base.

10. A cleat, comprising:

a first horn located opposite a second horn;

at least one support structure connected to said cleat, said at least one support structure having at least one recess, at least two ramps protruding from a wall surface of said at least one recess of said at least one support structure, whereby, said at least two ramps are oriented to form a pocket;

said at least one support structure having a bore, said bore of said at least one support structure is configured to receive a fastener; and, a base having a bore configured to receive said fastener, whereby, said bore of said at least one support structure is oriented to align with said bore of said base, whereby, at least one protrusion protrudes from a wall surface of said at least one recess of said base, said at least one protrusion is configured to deform a portion of a length of material.

11. The cleat of claim 10, further comprising said cleat having a light emitting unit.

12. The cleat of claim 10, further comprising said cleat having at least one compartment, said at least one compartment retaining a light emitting unit.

13. The cleat of claim 10, further comprising a power storage device.

14. The cleat of claim 13, further comprising said power storage device being rechargeable by at least one solar cell, said at least one solar cell positioned in at least one opening of at least one compartment.

15. The cleat of claim 10, further comprising said base having a tapered wall surface.

16. The cleat of claim 10, further comprising said base having a radial guide, said radial guide having a projecting structure configured to retain a portion of said length of material on said radial guide.

17. The cleat of claim 10, further comprising, said pocket having at least one protrusion, said at least one protrusion is configured to bind a portion of said length of material when said fastener is tightened.

18. The cleat of claim 10, further comprising at least one support structure having an alignment structure configured to mate with a mirroring alignment structure formed on said base.

19. A method of a bumper being suspended by a cleat anchoring system, comprising the steps of:

providing at least one bumper, said at least one bumper associated with at least one opening configured to support said at least one bumper;

providing a length of material;

providing at least one cleat comprising, a first horn located opposite a second horn, and at least one support structure, said at least one support structure of said at least one cleat is associated with a recess, whereby, said recess is configured to grip a portion of said length of material when said at least one support structure of said at least one cleat is fastened to an anchoring surface by a fastener;

placing said portion of said length of material between said recess of at least one support structure of said at least one cleat and said anchoring surface;

fastening said at least one support structure of said at least one cleat to said anchoring surface by said fastener; and, placing said length of material through said at least one opening associated with said at least one bumper.

20. The method of installing a bumper system suspended by a cleat having an adjustable anchoring structure of claim 19, further comprising the steps of providing a second cleat comprising, a first horn located opposite a second horn, and at least one support structure associated with a recess, said recess is configured to grip a portion of said length of material when said at least one support structure of said second cleat is fastened to an anchoring surface by a fastener, whereby, said at least one bumper is suspended between said first cleat and said second cleat.

21. The method of installing a bumper system suspended by a cleat having an adjustable anchoring structure of claim 20, further comprising the steps of providing a radial guide, said user passing said length of material over said radial guide, providing said second cleat having a second support structure associated with a second recess, said user placing said second portion of said length of material between said second support structure associated with said second recess, whereby, said second cleat is loosely fitted with said fastener of said second cleat, said user pulling said length of material to a desired length, said user tightening at least one fastener of said second cleat to retain said second portion of said length of material.

22. The method of installing a bumper system suspended by a cleat having an adjustable anchoring structure of claim 20, further comprising the steps of providing at least one retaining member, orienting said at least one retaining member on said length of material, whereby, said at least one retaining member is positioned to limit said at least one bumper from traversing said length of material in a first direction.

23. The method of installing a bumper system suspended by a cleat having an adjustable anchoring structure of claim 22, further comprising the steps of providing a second retaining member, and orienting said second retaining member on said length of material, whereby, said second retaining member is positioned to limit the movement of said at least one bumper from traversing said length of material in a second direction.

24. The method of installing a bumper system suspended by a cleat having an adjustable anchoring structure of claim 22, further comprising the steps of providing said at least one retaining member, whereby, said at least one retaining member having a first portion connected to a second portion by a hinge, at least one portion of said at least one retaining member having a protrusion configured to bind to a portion of said length of material when said at least one retaining member is in a closed orientation.

* * * * *